US008173881B1

(12) United States Patent
Schenk

(10) Patent No.: US 8,173,881 B1
(45) Date of Patent: May 8, 2012

(54) MUSICAL INSTRUMENT UTILIZING ILLUMINATED POSITION MARKERS AS STATUS INDICATORS

(76) Inventor: Roderick K. Schenk, Silverdale, WA (US)

( * ) Notice: Subject to any disclaimer, the term of this patent is extended or adjusted under 35 U.S.C. 154(b) by 0 days.

(21) Appl. No.: 12/835,694

(22) Filed: Jul. 13, 2010

Related U.S. Application Data

(60) Provisional application No. 61/270,893, filed on Jul. 13, 2009.

(51) Int. Cl.
*G10D 13/02* (2006.01)

(52) U.S. Cl. ..... 84/312 R; 84/314 R

(58) Field of Classification Search ..... 84/312 R, 84/314 R, 470 R, 485 R
See application file for complete search history.

(56) References Cited

U.S. PATENT DOCUMENTS

| | | | | |
|---|---|---|---|---|
| 5,388,496 | A | 2/1995 | Miller et al. | |
| 5,637,820 | A * | 6/1997 | Wittman | 84/454 |
| 7,049,502 | B2 | 5/2006 | Taku et al. | |
| 7,465,870 | B1 * | 12/2008 | Homan | 84/743 |

* cited by examiner

*Primary Examiner* — Kimberly Lockett
(74) *Attorney, Agent, or Firm* — James M. Duncan, Esq.; Klein, DeNatale, Goldner, et al.

(57) ABSTRACT

A stringed musical instrument has a sound chamber and a neck attached to the sound chamber. A fingerboard is attached along the neck. The musical instrument has an electronic device such as a chromatic tuner or a preamplifier, which is either mounted inside or on the exterior of the musical instrument. The fingerboard has a plurality of position markers which are flush with an edge face of the fingerboard. One or more of the position markers illuminates to display output from the electronic device. The position marker may either be the top of a light emitting diode attached to the electronic device, or the position marker may be the terminating end of a length of fiber optic cable, where the opposite end of the fiber optic cable abuts a light emitting diode mounted within the housing of the electronic device.

18 Claims, 5 Drawing Sheets

MUSICAL INSTRUMENT UTILIZING ILLUMINATED POSITION MARKERS AS STATUS INDICATORS

CROSS-REFERENCE TO RELATED APPLICATION

U.S. Provisional Application No. 61/270,893 for this invention was filed on Jul. 13, 2009 for which application this inventor claims domestic priority.

BACKGROUND OF THE INVENTION

The present invention generally relates to stringed musical instruments and more particularly to a stringed instrument comprising a fretboard (or fingerboard) whereupon the strings are fingered with the fingers of a musician's first hand to produce a desired musical tone when the strings are plucked, picked, bowed or otherwise actuated by the musician's second hand. The present invention more particularly relates to a status display incorporated into or adjacent to the fingerboard, the status display comprising the use of fretboard position markers for the status display, wherein the position markers comprise illumination means which are activated to indicate the status of the desired parameter, be it an indication of pick-up selection, an indication of the settings of volume or tone controls, or providing an indication whether a particular tone generated by a string has a desired pitch (i.e., whether the string is in tune to the desired pitch).

In most instances, the stringed instrument utilized in the present invention will comprise a sound chamber, or body, in which sound waves generated by the plucked strings are amplified by the vibrations of the materials forming the sound chamber and emitted from the sound chamber. However, the sound waves may also be amplified by electronic means, such as by various electrical pickups known in the art, in which case the body of the instrument may comprise a smaller sound chamber, or even be solid, such as in the case of a solid-body guitar.

For musical instruments such as a guitar, bass, mandolin, banjo, ukulele, violin, cello, etc., the sound chamber has a front (also referred to as the soundboard), sides, and usually a back.

For some of these instruments, the strings are attached on one end to a head at the end of a neck extending from the sound chamber, and attached at the other end to a bridge which is attached to the soundboard or, in some cases, such as with a violin, mandolin, cello, acoustic bass, or archtop guitar, the strings are attached to a "floating bridge" which extends from the "bottom" of the instrument (i.e., the end opposite the head of the instrument).

In the case of many musical instruments, such as acoustic guitars, the sides of the sound chamber generally comprise an upper bout, a waist, and a lower bout. As known by those skilled in the art, the lower bout is the large rounded bottom of the instrument, the upper bout is the smaller, rounded and convex shape at the top. Under the traditional design of acoustic guitars, the shape of the sound chamber is in the shape of a number "8", with the upper half, i.e., the upper bout, being smaller than the bottom half, i.e., the lower bout. The upper bout and lower bout are separated by the "waist" of the guitar, which is the concave transition between the upper and lower bouts.

For a right handed player, the right hand is typically utilized for bowing, picking, strumming, or otherwise actuating the strings. For the remainder of this description, it will be assumed that the instrument is "right handed", i.e., built to be played by a right-handed person. However, correlating the description for a left-handed instrument only requires the assumption that the right hand is utilized for fingering the notes and the left hand is utilized for bowing, picking or strumming the strings.

The sides of the instrument may, for purposes of description, be identified with respect to the strings. The treble strings of the instrument are usually on the side of the instrument generally facing downward as it is played, while the bass strings are on the side of the instrument generally facing upward as the instrument is played. Using the strings as a point of reference, the sides of a stringed instrument may be referred to as the treble side and the bass side. With respect to the string orientation described above, for instruments played with the soundboard generally facing away from the musician, such as guitar, mandolin, etc, the side of the instrument generally facing downward while played is considered as the treble side of the instrument and the side of the instrument facing upward is considered as the bass side of the instrument. The upper bout may therefore may be further described as having a treble side upper bout and a bass side upper bout and, likewise, the lower bout may be further described as having a bass side lower bout and a treble side lower bout.

For the typical right handed player, the upper bout of the instrument is adjacent to the player's left arm, and the lower bout is adjacent to the player's right arm. The left hand is utilized for fingering or otherwise actuating notes on the fretboard, where the fretboard is disposed on the neck of the instrument. For many stringed instruments, a portion of the fretboard cantilevers over the soundboard. The portion of the fretboard cantilevering over the soundboard is typically referred to as the fretboard extension. On some instruments, notably guitar, mandolin, banjo, ukulele, and (usually) bass, the fretboard may comprise a plurality of frets extending over its length, which enable the musician to locate a fingering position. However, it is to be appreciated that because there may be a large number of frets on the fingerboard, such as twenty-four on some guitars, it can be difficult to immediately ascertain a desired finger position on the fingerboard.

For many instruments, including guitar, mandolin, ukulele, banjo, bass, etc., it is common to use position indicators to assist a player in locating the notes on the fretboard. The position indicators are frequently inlayed or painted "dots" which may be place within the fretboard itself, such that the position indicators are on the face of the fretboard. Alternatively, or additionally, the position indicators may be inlayed dots which are located in the side of the fretboard (or binding material which is placed over the side of the fretboard), such that a player in a standing position for a guitar or similar instrument, is looking down at the position markers, which are located on the bass side of the neck.

In addition to the usual locations along the fretboard, such as the fifth, seventh, and ninth frets, the position indicators may also extend into the fretboard extension. For guitars, the position indicators are typically located at the $15^{th}$, $17^{th}$ and $19^{th}$ frets of the fretboard extension in addition to other locations on the fretboard. The inlay materials often comprise organic shell material such as abalone or mother of pearl to enhance the appearance of the instrument because of the contrast of those glimmering materials with the typical dark wood of the fretboard.

Under the traditional design for guitars, the exterior of the sound chamber has been symmetric, where the treble side and bass side are matching. However, over the years, instrument makers have modified the traditional design. One of the most common of these modifications, which results in an asymmetrical sound chamber, has been to fashion a "cut-away"

into the treble side of the upper bout and upper portion of the soundboard adjacent to the neck on the treble side to allow the player greater access to the portions of the fretboard adjacent to the body of the guitar.

It is to be appreciated that the strings of the instruments must be in tune for the instrument to produce pleasing music. The instrument may be in tune relative to itself, where the strings of the instrument are in tune with one another but not necessarily in tune with a fixed standard. However, it is generally preferable to tune the instrument according to a standard pitch so that the instrument may be played with other instruments, or to play a particular piece in the pitch desired by a musical composer. With the development of electronic chromatic tuners, it is now relatively easy to determine whether the strings of the instrument are properly tuned to the desired pitch. Typically such tuners utilize a meter which indicates whether a played tone is sharp, flat, or in tune to a particular pitch. Such tuners may also comprise light emitting diode ("LED") displays which provide a display showing whether the played tone is sharp, flat or in tune. Such tuners are sold by KORG, INTELLITOUCH, BOSS, SABINE and PLANET WAVES and described in various patents, such as U.S. Pat. Nos. 5,388,496 and 7,049,502, which both disclose tuning devices having LED displays, where the tuning devices may be temporarily mounted on the guitar. It is also known for acoustic and electric guitars, to have on-board tuners which are permanently mounted within the instrument. An example of such an onboard tuner is disclosed in U.S. Pat. No. 5,637,820.

While the known devices satisfactorily enable the musician to tune the stringed instrument, there are also various drawbacks and disadvantages. For the temporarily mounted devices, the musician must typically separately transport the device and install it before a performance, such that the tuning device may be forgotten or mislocated. Some of the temporary devices employ adhesives or spring clamps which can potentially damage the finish of the instrument. For the known onboard devices, the device can be difficult for the musician to see the display. In addition, particularly because the device is usually a permanent part of the instrument, some onboard devices detract from the physical appearance of the instrument. This can be a significant consideration, particularly in the case of expensive and visually attractive instruments, such as high end custom acoustic guitars, where the appearance of the guitar can be of great importance to the musician.

SUMMARY OF THE INVENTION

The disclosed apparatus, and method of installing the same, resolves the drawbacks and disadvantages discussed above. An embodiment of the disclosed apparatus comprises a status display for a musical instrument which utilizes one or more of the position markers located on or adjacent to the fretboard as status display indicators for the instrument by utilizing illumination means with the position indicator.

In one embodiment, one or more position markers may comprise the terminating ends of lengths of fiber optic cable, where the terminating end is flush with the surface of the surrounding material of either the fretboard or binding material such that the terminating end appears, when not illuminated, to be a conventional position indicator. The opposite end of the length of fiber optic cable is abutted to an electronic illumination device, such as a light emitting diode (or "LED") which is mounted within a small electronic tuner (or other electronic device), the tuner mounted within the sound chamber of the instrument or other location. For the purpose of this description, the term light emitting diode or LED also refer to other electronic illumination devices utilized with electronic devices.

Alternatively, the illumination means may comprise an LED conductively connected to the electronic tuner (or other electronic device) utilizing small connecting wires. The tuner may be removeably installed such that it is not normally visible from the outside of the instrument, but may be easily removed for battery change, replacement or permanent removal.

In the case of a tuner, three lengths of fiber optic cable may be utilized, corresponding to the LEDs in the electronic tuner which indicate sharp, flat, and correct pitch. For application in a guitar, the terminating ends of the fiber optic cables may be mounted as the position indicators which are conventionally mounted at the $15^{th}$, $17^{th}$, and $19^{th}$ frets, although it is to be appreciated that other position indicators may be utilized. The terminating end of the fiber optic cable at the $15^{th}$ fret may be illuminated when the played tone is flat, the terminating end at the $17^{th}$ fret may be illuminated when the played tone is at correct pitch, and the terminating end at the $19^{th}$ fret may be illuminated when the played tone is sharp. The electronic tuner may utilize different LED colors which are transmitted through the fiber optic cable to the terminating end. For example, a blue light may be emitted at the position markers at the $15^{th}$ fret or $19^{th}$ fret when the tone is flat or sharp, while the position indicator at the $17^{th}$ fret may emit a white light when the played tone is at correct pitch.

Alternatively, rather than utilizing the terminating ends of fiber optic cables, LEDs may be utilized for the position indicators, where each LED is mounted such that the tip of the LED is flush mounted within the fretboard. Connecting wires from each LED may then be disposed beneath the fretboard and routed to the electronic device in a similar manner as the figures show the routing of the fiber optic cable. However, because the connecting wires have substantially more flexibility than the fiber optic cable, and have a smaller diameter, routing the connecting wires is generally easier than the routing of the fiber optic cables.

The electronic device may have a remotely located on-off switch, such that the musician can easily turn the tuner on or off. For example, the remove switch may be located adjacent to the soundhole of a guitar such that the musician simply reaches inside the soundhole to activate the switch.

It is to be appreciated that utilization of the position marker status indicators discussed above might be utilized for other purposes. For example, to indicate whether an on-board preamplifier or other onboard electronics have been activated or to provide an indication of the settings of tone and volume controls. This application of utilizing the terminating end of a length of fiber optic cable in a musical instrument as a position marker at the fretboard and coupling the opposite end of the fiber optic cable to an LED disposed within an electronic device is not known. It is also not known to utilize LEDs as position markers where the LEDs also provide the status of the instrument, or its onboard electronics.

DETAILED DESCRIPTION OF THE EMBODIMENTS

Figure 1:
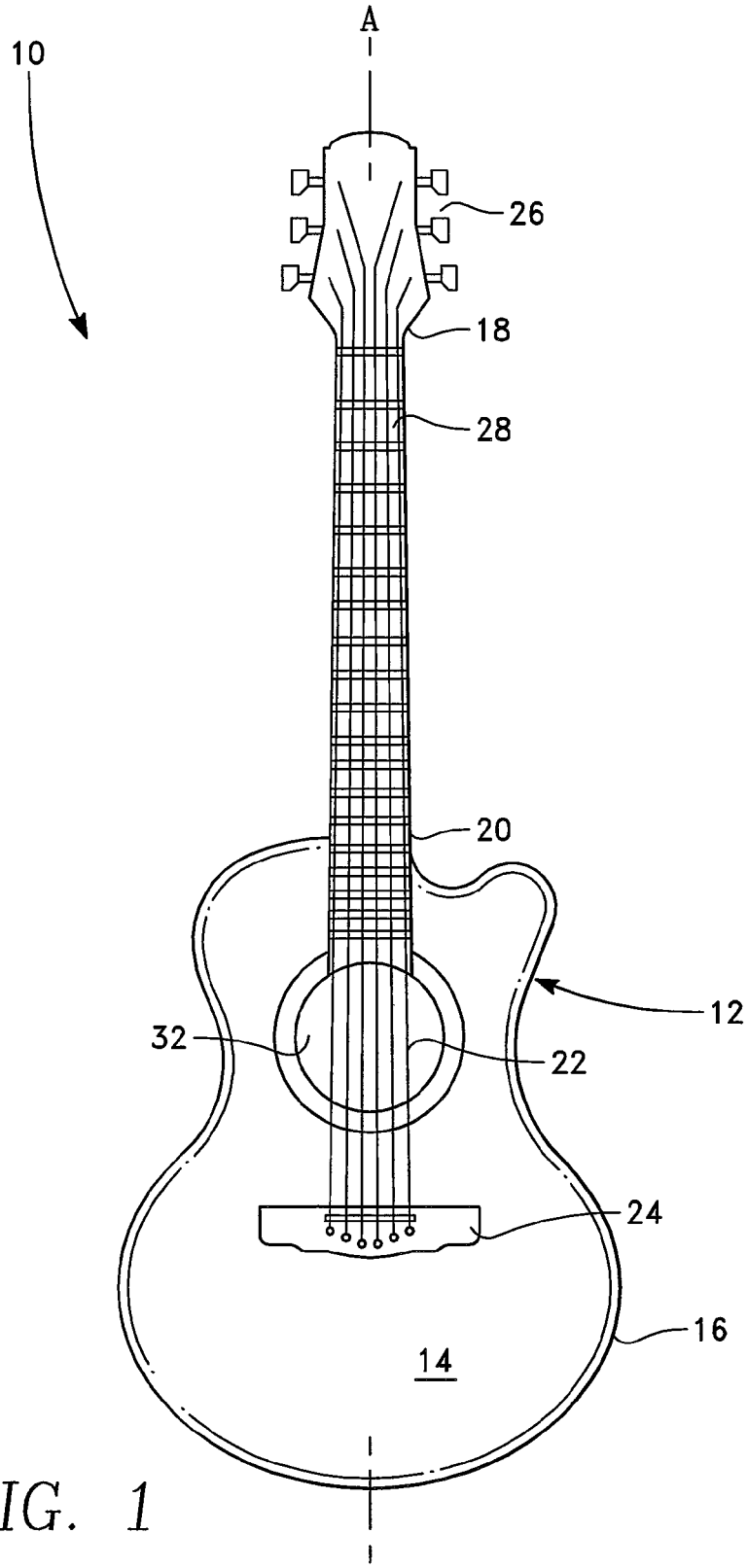
FIG. 1 shows an example of a musical instrument, a guitar, which may comprise embodiments of the disclosed invention.

Referring now to the figures, FIG. 1 depicts a musical instrument 10, in this case a guitar, which may embody the disclosed invention. The musical instrument 10 comprises a sound chamber 12 which formed by a soundboard 14, sides 16 and back (not shown). The musical instrument 10 further comprises a neck 18 which is attached to the sound chamber 12, where a longitudinal axis A is defined by the orientation of the neck and sound chamber. The neck 18 comprises a fingerboard 20 which is disposed along a portion of the neck. Depending upon the instrument, neck 18 may further comprise a heel 30 where the neck attaches to the sound chamber 12. The musical instrument may further comprise a plurality of strings 22 which are strung between a bridge piece 24 and a head stock 26, such that the strings are positioned above the sound chamber 12 and the fingerboard 20, and oriented along the longitudinal axis A. Depending upon the particular type of musical instrument 10, the instrument may comprise a sound hole 32.

The fingerboard 20 comprises a top surface 28, which is utilized by the musician for fingering the strings, such that depressing the strings against the fingerboard enables the musician to play different tones on the instrument. The fingerboard 20 also comprises edge surfaces 34, best seen in FIG. 6, which shows the bottom side of fingerboard 20. For guitars, the fingerboard 20 also comprises frets 36 which divide the fingerboard 20.

Figure 8:
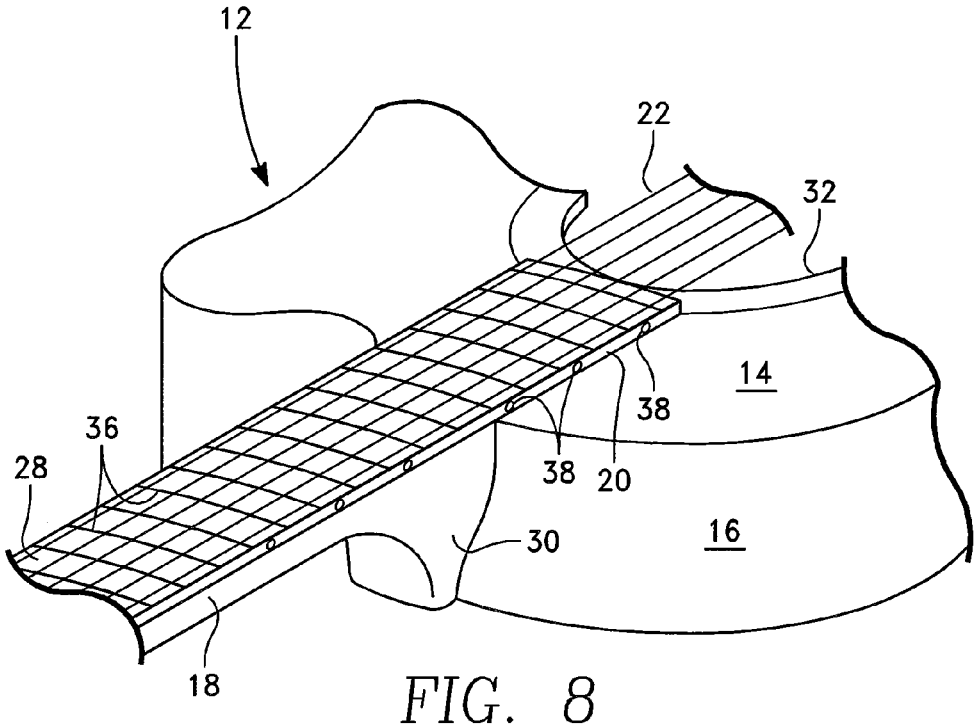
FIG. 8 shows the illuminated positional indicators. The positional indicators may be illuminated when the electronic tuner or other device is first activated to show the device is on and operational.

The fingerboard 20 also comprises a plurality of position markers 38. The position markers 38 provide an indication of a location for the user's fingers on the fingerboard to produce one or more particular tones from the strings, particularly when the instrument has frets 36, such that the position markers provide visual aid to the musician in placing his or her fingers at the correct frets. The position markers 38 are typically flush mounted within either the top surface 28 or edge surfaces 34, and are often formed with materials such as mother of pearl or other luminescent shell material to provide aesthetic appeal. When the position markers 38 are placed within the edge surfaces 34, the usual configuration is a round dot. For guitars, the position markers are usually placed at the $5^{th}$, $7^{th}$, $9^{th}$, $12^{th}$, $15^{th}$, $17^{th}$, and $19^{th}$ frets. As shown in FIG. 8, for a guitar, the position markers 38 are easily seen by the user if the neck of the instrument is held within the left hand of the user, such that the user would typically be looking directly down at the position markers. For this reason, position markers 38 are often only used on the edge surfaces.

The invention further comprises an electronic device 40 which is contained either inside the instrument, or mounted to its exterior. If contained on the inside of the instrument 10, typically the electronic device 40 will be contained inside the sound chamber 12. The electronic device 40 may comprise an electronic tuner, preamplifier, or an effects device, such as onboard chorus or like device. The electronic device 40 may comprise a housing 42 for containing circuit boards and other components. In the present invention, the electronic device 40 will comprise one or more light emitting diodes 44 or other electronic illumination means. The electronic device 40 will also comprise switching means for activating the device, such as a remote on-off switch 46 which is connected to the housing 42. Remote on-off switch 46 may be positioned near soundhole 32 for easy access by the user.

The novel and surprising feature of the present invention is the utilization of the position markers 38 as status indicators, where one or more of the position markers 38 are illuminated by various means upon receiving various output from the electronic device. The present invention provides illumination to the position markers 38 by either utilizing the top of a light emitting diode 44 as the position marker, or by utilizing the end of fiber optic cables 54 to function as position indicators, where the opposite ends of the fiber optic cables are abutting light emitting diodes, such that the light signal is transmitted from the light emitting diode, through the fiber optic cables, and illuminating the end of the fiber optic cable functioning as the position marker.

Figure 2:
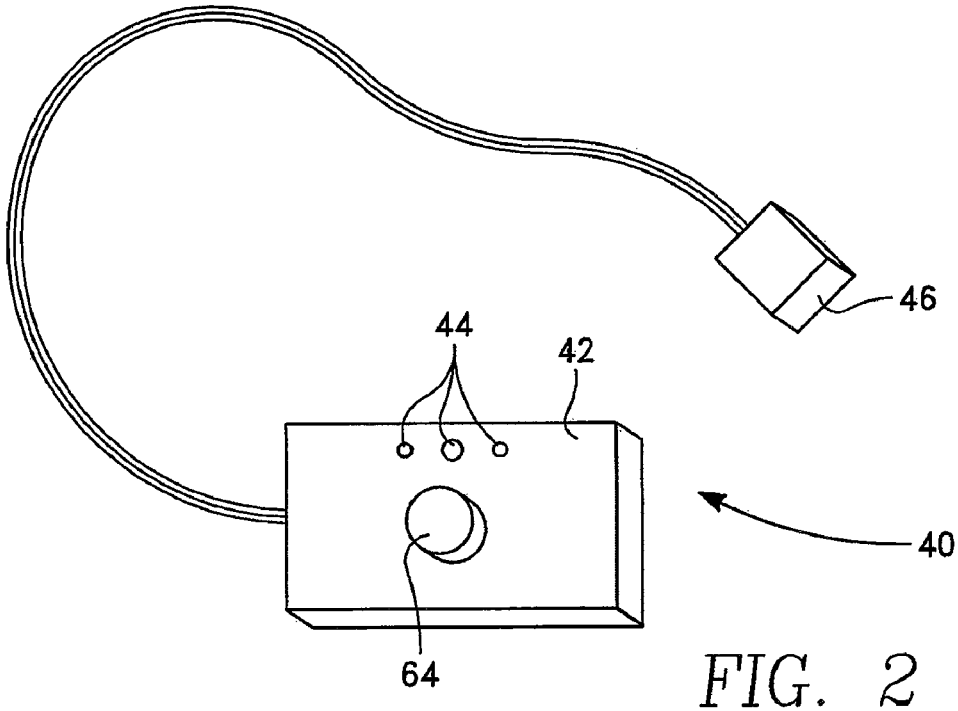
FIG. 2 shows an embodiment of an electronic tuning device, with a remote on-off switch, which may be utilized in the present invention.

As an example, the electronic device 40 of FIG. 2 may comprise an electronic tuner. The tuner receives a string vibration signal either physically through vibration or through audible vibration picked up by onboard microphone. With reference to the arrangement of the light emitting diodes 44 in FIG. 2, if the tone played on a string is chromatically in tune, the center light emitting diode may be illuminated. If the light emitting diode 44 on the left side is illuminated, it may indicate that the played tone is "flat," while an illuminated light emitting diode on the right side may indicate the played tone is "sharp." The different colors of light emitting diode 44 may be utilized according to preference. The LED bulbs may preferably comprise either 3 mm or 5 mm in diameter and have a luminous intensity range from 10,000 to 18,000 mcd. The tuner and LED bulbs are powered by on-board batteries. The tuner may have an automatic shut-off circuit which causes the unit to shut off after a few minutes to conserve the battery life.

Figure 6:
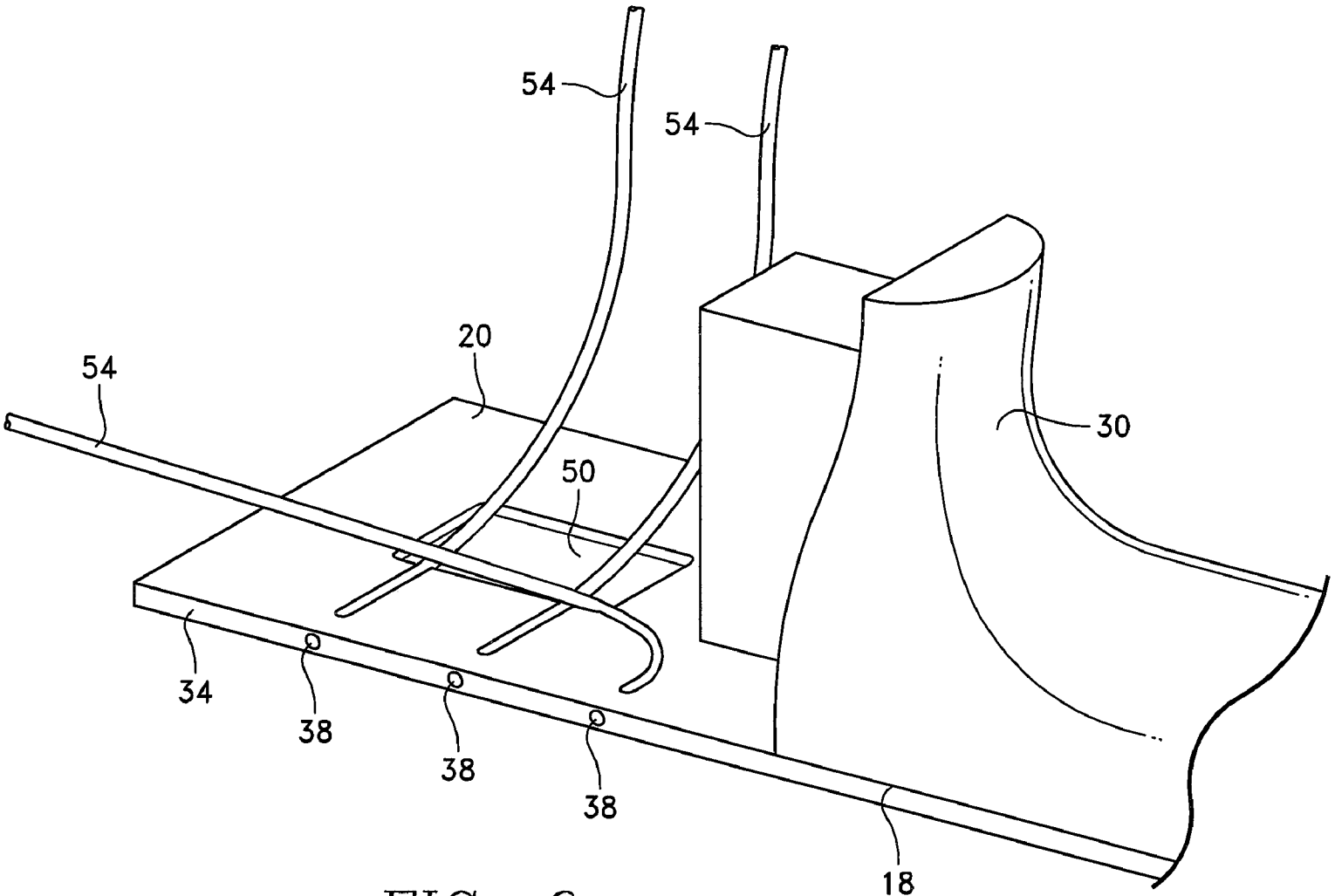
FIG. 6 shows the fretboard, attached to an instrument neck, showing how fiber optic cables may be installed, such that the terminating ends of the fiber optic cable are flush with the sides of the fretboard.
Figure 7:
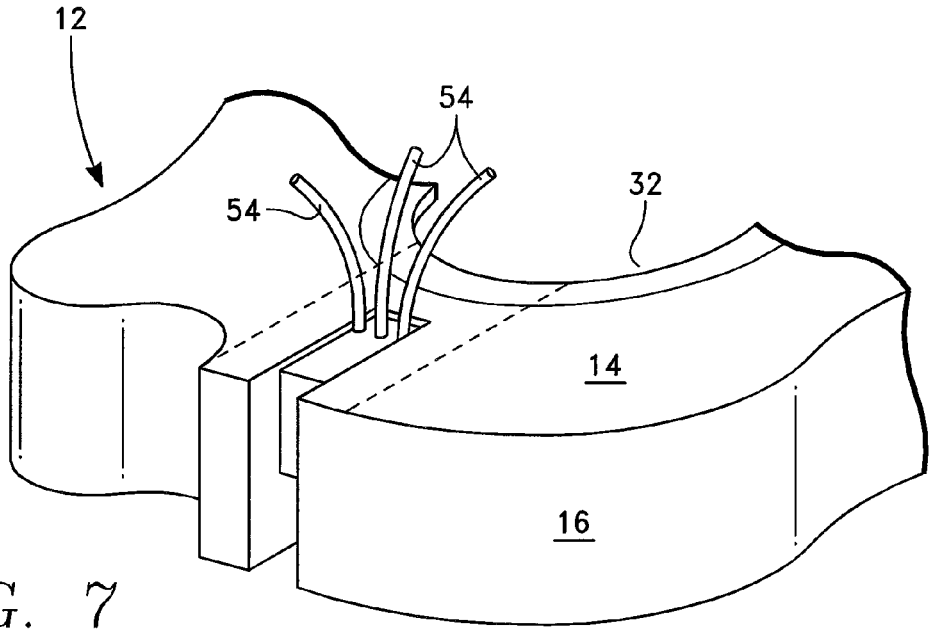
FIG. 7 shows how the fiber optic cables (or instrument wire) may be threaded into channels in the instrument soundboard as the neck is attached to the body of the instrument.

The light emitting diodes 44 may either be retained within a housing 42 as shown in FIG. 2, or the light emitting diodes may utilize long lead wires which extend between the housing 42 and the edge surface 34 where the tops of the light emitting diodes function as position markers 38. In this configuration, the lead wires are routed from the sound chamber 12, as illustrated in FIG. 7, through the neck 18 into a cavity 50 which is machined into the underside of fingerboard 20. Channels 52 extend from cavity 50 through the fingerboard 20 to the edge surface 34 as best shown in FIG. 6. When installed, the tops of the light emitting diodes are flush with edge surface 34, forming position markers 38.

Figure 3:
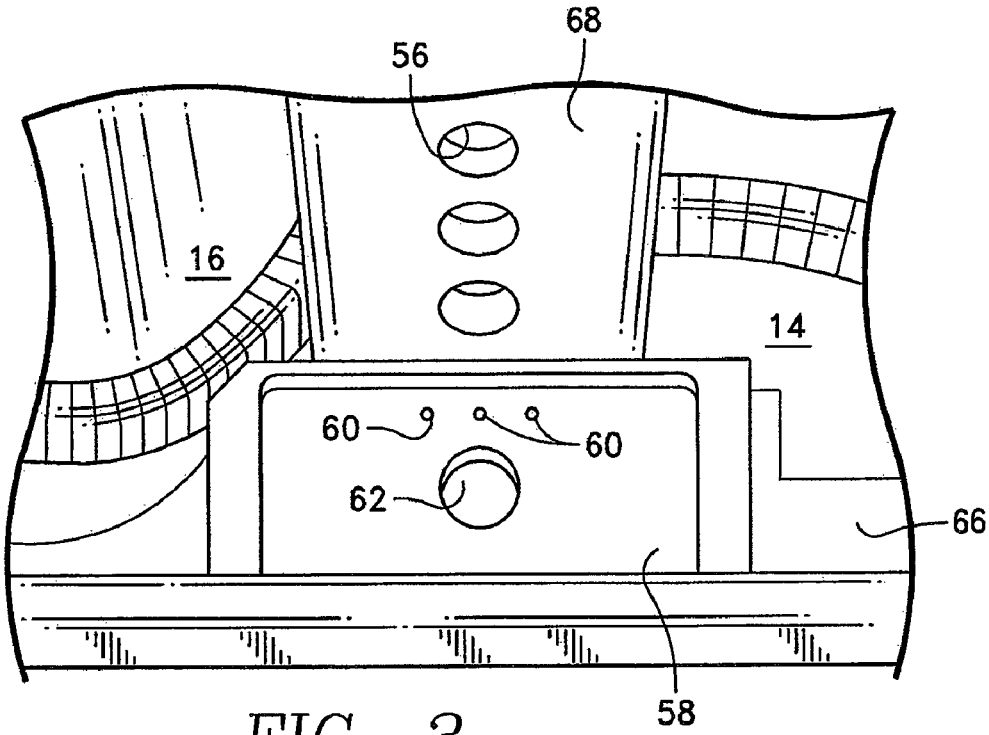
FIG. 3 shows the placement of a mounting plate in the interior of a musical instrument, where the mounting plate is mounted on the underside of the instrument top, abutting the head block.
Figure 4:
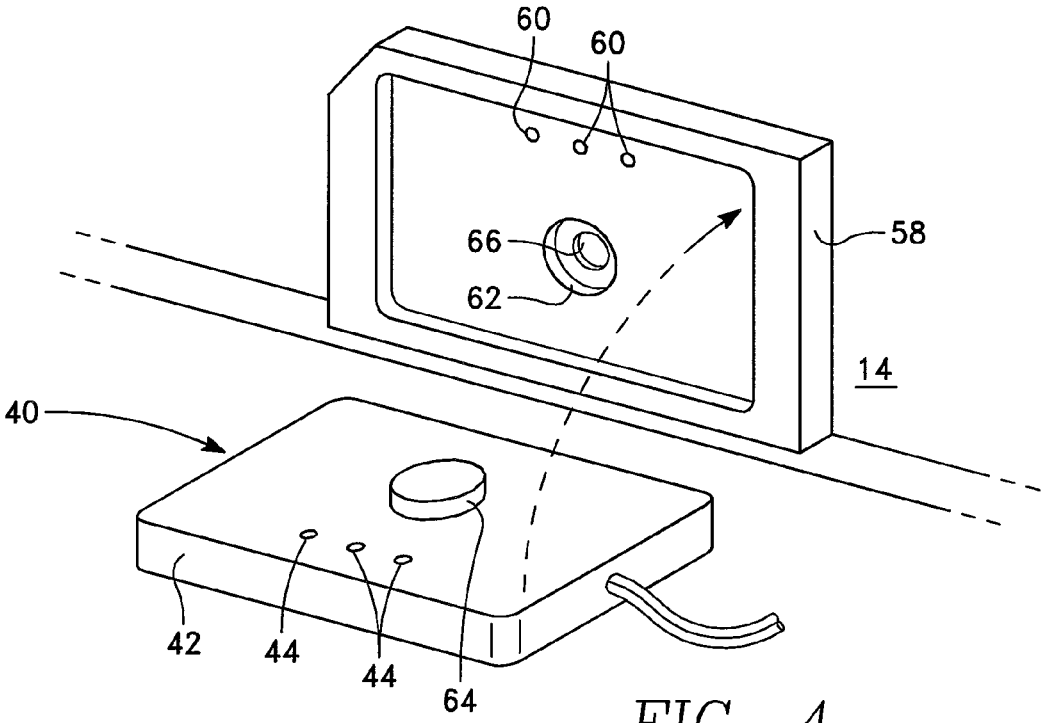
FIG. 4 shows how the electronic device of FIG. 1 may be removeably attached to the mounting plate shown in FIG. 3
Figure 5:
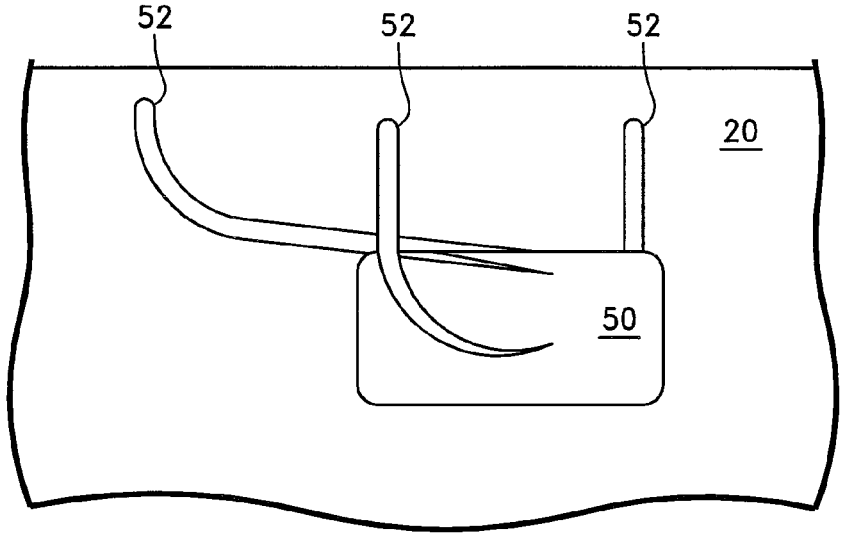
FIG. 5 shows the underside of a fretboard, showing how channels and a cavity may placed in an instrument fret board for disposition of fiber optic cable or instrument wires.

Alternatively, fiber optic cables 54 may be utilized for transmitting photons from light emitting diodes 44 contained within housing 42, to the edge surface 34, where the ends of the fiber optical cables are utilized as the position markers 38. The benefit of this embodiment is that if the light emitting diodes fail, the entire electronic device 40 may be easily removed and replaced without having to access the neck 18 of the instrument. In this embodiment, the electronic device 40 is preferably placed inside the sound chamber 12 in a location in close proximity to the neck 18, where the electronic device is removably attached. FIGS. 3 and 4 show structure which allow the removable attachment of an electronic device 40 in a desired location within a musical instrument 10. For a guitar, FIG. 3 provides a view showing the headblock 68 of the instrument. FIG. 3 shows side 16 and shows the bottom side of soundboard 14. Neck 18 is typically attached to sound chamber 12 with bolts inserted through bolt holes 56 in the headblock 68.

A mounting plate 58 is attached to structure within the sound chamber 12. In FIG. 3, the mounting plate 58 is attached to a brace 66 which supports soundboard 14. When mounting plate 58 is installed, holes 60 are drilled through the mounting plate and through soundboard 14. Mounting plate 58 further comprises means for removably attaching electronic device 40. One acceptable means of attaching electronic device 40 is by utilizing magnets, so mounting plate 58 may comprise an aperture 62 which has a metallic structure disposed within the aperture, such as a washer 66. Electronic device 40 may comprise a magnet 64 which corresponds to the position of aperture 62 and washer 66. As shown in FIG. 4, electronic device 40 may be disposed within mounting plate 58, such that magnet 64 attaches to washer 66, thus securely retaining the electronic device within the mounting plate 58. It is to be noted that when electronic device 40 is mounted, it is firmly retained within mounting plate 58, and that light emitting diodes 44 are in alignment with holes 60.

FIG. 7 shows the outside of the sound chamber 12 before the neck 18 has been installed. Fiber optic cables 54 are inserted through holes 60. The fiber optic cables 54 each have a first end which is inserted into hole 60 and abutted directly against a respective light emitting diode 44 which is on the opposite side of the soundboard 14 as shown in FIG. 4. The free ends or second ends of the fiber optic cables 54 are placed into cavity 50 in the underside of fingerboard 20 and threaded into channels 52, such that the second ends of the fiber optic cables form one or more of the position markers 38. Neck 18 is mounted after the fiber optic cables 54 are routed.

The embodiment utilizing fiber optic cables for light transmission is utilized in a similar same manner as the embodiment which utilizes the tops of the light emitting diodes, except the transmitted signal is photons rather than electrical current. The electronic device 40 may be turned on with remote switch 46. By way of example of how the position markers may be utilized, if the electronic device is a chromatic tuning device, the user will play a tone on a string. If the string is in tune, the position marker at the $17^{th}$ fret will be illuminated. If the string is flat, the position marker at the $15^{th}$ fret will be illuminated. If the string is sharp, the position marker at the $19^{th}$ fret will be illuminated.

While the above is a description of various embodiments of the present invention, further modifications may be employed without departing from the spirit and scope of the present invention. Thus the scope of the invention should not be limited according to these factors, but according to the following appended claims.

What is claimed is:

1. A musical instrument comprising:

a sound chamber and a neck attached to the sound chamber, a fingerboard disposed along a portion of the neck, the sound chamber and neck defining a longitudinal axis;

a plurality of strings positioned above the sound chamber and fingerboard, the strings oriented along the longitudinal axis;

an electronic device contained within or on the instrument, the electronic device generating output upon activation by a user, wherein the electronic device is removably attached to a mounting plate, wherein the electronic device comprises an outer housing having a magnet attached thereto, and the magnet attaches to a metallic member of the mounting plate; and the fingerboard comprising a top surface and edge surfaces on either side of the top surface, the fingerboard further comprising a plurality of position markers flushly mounted within the top surface or one of the edge surfaces, the position markers of the type which provide an indication of a location for the user's fingers on the fingerboard to produce one or more particular tones from the strings, wherein one or more of the position markers comprises means for illuminating upon receiving output from the electronic device.

2. The musical instrument of claim 1 wherein the musical instrument comprises a guitar.

3. The musical instrument of claim 1 wherein the electronic device is connected to one or more light emitting diodes wherein each light emitting diode comprises a top surface and the position markers comprise the top surface of the light emitting diode.

4. The musical instrument of claim 1 wherein the electronic device comprises a housing having one or more light emitting diodes wherein each light emitting diode comprises a top surface, and a first end of a fiber optic cable is abutted against the top surface, wherein the fiber optic cable comprises a second end, wherein the second end comprises an illuminating position marker.

5. The musical instrument of claim 1 wherein the electronic device is a digital tuner.

6. The musical instrument of claim 5 wherein the digital tuner illuminates a first light emitting diode if an inputted tone is flat, illuminates a second light emitting diode if an inputted tone is sharp, and illuminates a third light emitting diode if an inputted tone is in tune.

7. The musical instrument of claim 6 wherein the light emitting diodes comprise a top surface and the position markers comprise the top surfaces of the first light emitting diode, the second light emitting diode, and the third light emitting diode.

8. The musical instrument of claim 6 wherein a first end of a first fiber optic cable is abutted against the first light emitting diode, a first end of a second fiber optic cable is abutted against the second light emitting diode, and a first end of a third fiber optic cable is abutted against the third light emitting diode, wherein the first fiber optic cable, the second fiber optic cable and the third fiber optic cable each comprise a second end, and the position markers respectively comprise the second ends of the first fiber optic cable, the second fiber optic cable, and the third fiber optic cable.

9. The musical instrument of claim 1 wherein the electronic device comprises a remotely actuated control switch.

10. The musical instrument of claim 1 wherein the electronic device is contained within the sound chamber.

11. A musical instrument comprising:

a sound chamber and a neck attached to the sound chamber, a fingerboard disposed along a portion of the neck, the sound chamber and neck defining a longitudinal axis;

a plurality of strings positioned above the sound chamber and fingerboard, the strings oriented along the longitudinal axis;

an electronic device contained within or on the instrument, the electronic device generating output upon activation by a user, the electronic device comprising a housing having one or more light emitting diodes wherein each light emitting diode comprises a top surface;

a first end of a fiber optic cable abutted against the top surface of each light emitting diode, wherein the fiber optic cable comprises a second end;

the fingerboard comprising a top surface and edge surfaces on either side of the top surface, the fingerboard further comprising a plurality of position markers flushly mounted within the top surface or one of the edge surfaces, the position markers of the type which provide an indication of a location for the user's fingers on the fingerboard to produce one or more particular tones from the strings, wherein one or more of the position markers comprises the second end of a fiber optic cable.

12. The musical instrument of claim 11 wherein the sound chamber comprises a soundboard, and the electronic device is contained within the sound chamber.

13. The musical instrument of claim 12 wherein the fiber optic cable is routed through the soundboard and through the neck.

14. The musical instrument of claim 11 wherein the electronic device is a digital tuner.

15. The musical instrument of claim 14 wherein the digital tuner illuminates a first light emitting diode if an inputted tone is flat, illuminates a second light emitting diode if an inputted tone is sharp, and illuminates a third light emitting diode if an inputted tone is in tune.

16. The musical instrument of claim 15 wherein a first end of a first fiber optic cable is abutted against the first light emitting diode, a first end of a second fiber optic cable is abutted against the second light emitting diode, and a first end of a third fiber optic cable is abutted against the third light emitting diode, wherein the first fiber optic cable, the second fiber optic cable and the third fiber optic cable each comprise a second end, and the position markers respectively comprise the second ends of the first fiber optic cable, the second fiber optic cable, and the third fiber optic cable.

17. The musical instrument of claim 15 wherein the digital tuner comprises a remotely actuated control switch.

18. The musical instrument of claim 14 wherein the digital tuner is removably attached to a mounting plate contained within the sound chamber.

* * * * *